US011035567B2

(12) United States Patent
Brown

(10) Patent No.: US 11,035,567 B2
(45) Date of Patent: Jun. 15, 2021

(54) ILLUMINATED CONTAINER APPARATUS

(71) Applicant: FUSE, LLC, Memphis, TN (US)

(72) Inventor: Matthew S. Brown, Falkner, MS (US)

(73) Assignee: FUSE, LLC, Memphis, TN (US)

( * ) Notice: Subject to any disclaimer, the term of this patent is extended or adjusted under 35 U.S.C. 154(b) by 0 days.

(21) Appl. No.: 16/809,187

(22) Filed: Mar. 4, 2020

(65) Prior Publication Data

US 2020/0284424 A1 Sep. 10, 2020

Related U.S. Application Data

(60) Provisional application No. 62/814,072, filed on Mar. 5, 2019.

(51) Int. Cl.

| | |
|---|---|
| ***F21V 33/00*** | (2006.01) |
| ***F41C 33/06*** | (2006.01) |
| ***F21V 23/04*** | (2006.01) |
| *F21Y 115/10* | (2016.01) |

(52) U.S. Cl.

CPC ..... *F21V 33/0084* (2013.01); *F21V 23/0485* (2013.01); *F41C 33/06* (2013.01); *F21Y 2115/10* (2016.08)

(58) Field of Classification Search

CPC ... F21V 33/0084; F21V 23/0485; F41C 33/06
See application file for complete search history.

(56) References Cited

U.S. PATENT DOCUMENTS

| | | | | |
|---|---|---|---|---|
| 5,009,088 | A * | 4/1991 | Cislo | F41C 33/06 109/51 |
| 7,055,983 | B1 * | 6/2006 | Baker | A01K 97/06 362/154 |
| 9,566,704 | B1 * | 2/2017 | Stoikos | B25H 3/06 |
| 9,568,186 | B2 | 2/2017 | Brown | |
| 9,671,158 | B1 | 6/2017 | Sandberg et al. | |
| 10,827,863 | B2 | 11/2020 | Brown et al. | |
| 2012/0021181 | A1 * | 1/2012 | Thompson | B32B 7/12 428/159 |
| 2019/0185114 | A1 * | 6/2019 | Voaklander | B63B 45/00 |
| 2020/0003487 | A1 | 1/2020 | Brown | |

FOREIGN PATENT DOCUMENTS

WO WO2019/084542 A1 5/2019

* cited by examiner

*Primary Examiner* — Donald L Raleigh
(74) *Attorney, Agent, or Firm* — Ashley Law Firm P.C.; Stephen S. Ashley, Jr.

(57) ABSTRACT

A container apparatus can include a container and an illumination apparatus positioned within the container. The illumination apparatus includes a cushioning section, and a light emitting device positioned within the cushioning section. The cushioning section can be comprised of solid foam. The light emitting device can be a light emitting diode.

20 Claims, 6 Drawing Sheets

ILLUMINATED CONTAINER APPARATUS

CROSS REFERENCE TO RELATED APPLICATIONS

This application claims priority to U.S. Patent Application No. 62/814,072, filed Mar. 5, 2019, which is incorporated by reference herein.

TECHNICAL FIELD

The present invention relates to containers and illuminated devices. One embodiment of the invention comprises an illuminated container apparatus.

BACKGROUND

It is common when using a container for the user to desire a light to illuminate the interior of the container. For example, in the case of a toolbox, light can aid the user in grasping a particular tool in the toolbox at night or in a dimly lit area. Attempts have been made in the prior art to address this need. However, many such prior art devices comprise containers in which lights are electrically wired to the container itself. Such a system can be relatively expensive, and if the lights fail it is generally difficult and impractical to repair. Also, it can be relatively difficult to replace batteries in such containers.

SUMMARY

One object of the present invention is to provide an illumination device that can be retrofitted into existing containers. Another object of the invention is to provide an illumination device that can be shaped and sized to fit within containers of various shapes and dimensions. Another object of the invention is to provide an illumination device that can be used in a container without electrically connecting the device to the container. These and other objects of the invention can be achieved in one or more embodiments of the invention described herein.

One embodiment of the invention comprises an illuminated foam that can be adapted for use in a variety of containers.

Another embodiment of the invention comprises an illumination apparatus comprised of a foam material, and at least one light emitting device positioned within the foam material.

Another embodiment of the invention comprises a container comprising an illuminated foam.

According to an embodiment of the invention, the container can be a toolbox, fishing tackle box, gun case, or luggage.

Another embodiment of the invention comprises a kit comprising a container and an illumination apparatus. According to an embodiment of the invention, the illumination apparatus comprises a solid foam material and at least one light emitting device positioned within the foam material.

Another embodiment of the invention comprises an illumination apparatus comprised of an aerogel material, and at least one light emitting device positioned within the aerogel material.

Another embodiment of the invention comprises a container comprising an illuminated aerogel.

Another embodiment of the invention comprises a method of making a container apparatus comprising an illuminated foam.

Another embodiment of the invention comprises an illumination apparatus comprising a foam section, a recess formed in the foam section, and a light emitting device removably positioned within the recess.

According to an embodiment of the invention, the foam section can be comprised of polyurethane and/or polystyrene.

According to another embodiment of the invention, the light emitting device comprises at least one light emitting diode.

According to another embodiment of the invention, the light emitting device includes a touch sensitive on/off mechanism, such as a capacitive touch sensor.

Another embodiment of the invention comprises a container and an illumination apparatus positioned within the container. The illumination apparatus can comprise a cushioning section, and a light emitting device positioned within the cushioning section.

According to another embodiment of the invention, the cushioning section is comprised of a solid foam.

According to another embodiment of the invention, the solid foam can be polyurethane or polystyrene.

According to another embodiment of the invention, the cushioning section can be comprised of an aerogel material, such as silica aerogel or tantalum aerogel.

According to another embodiment of the invention, the container can be a toolbox, fishing tackle box, gun case, and luggage.

According to another embodiment of the invention, the light emitting device can comprise one or more light emitting diodes.

According to another embodiment of the invention, the light emitting device includes a touch sensitive on/off mechanism operatively connected to the light emitting diode, so that pressing on the cushioning section can turn the light emitting diode on and off.

According to another embodiment of the invention, a recess can be formed in the cushioning section and the illumination apparatus is positioned within the recess.

According to another embodiment of the invention, a slit can be formed in communication with the recess, such that the light emitting device can be slid and out of the recess.

Another embodiment of the invention comprises a method of making a container apparatus. A container is provided having an interior surface defining a size and shape. A piece of solid foam is cut to conform to the size and shape of the interior of the container, and an opening is cut in the piece of solid foam. A light emitting device is inserted into the piece of solid foam. The piece of solid foam is positioned with the interior of the container.

DETAILED DESCRIPTION OF PREFERRED EMBODIMENTS

Figure 1:
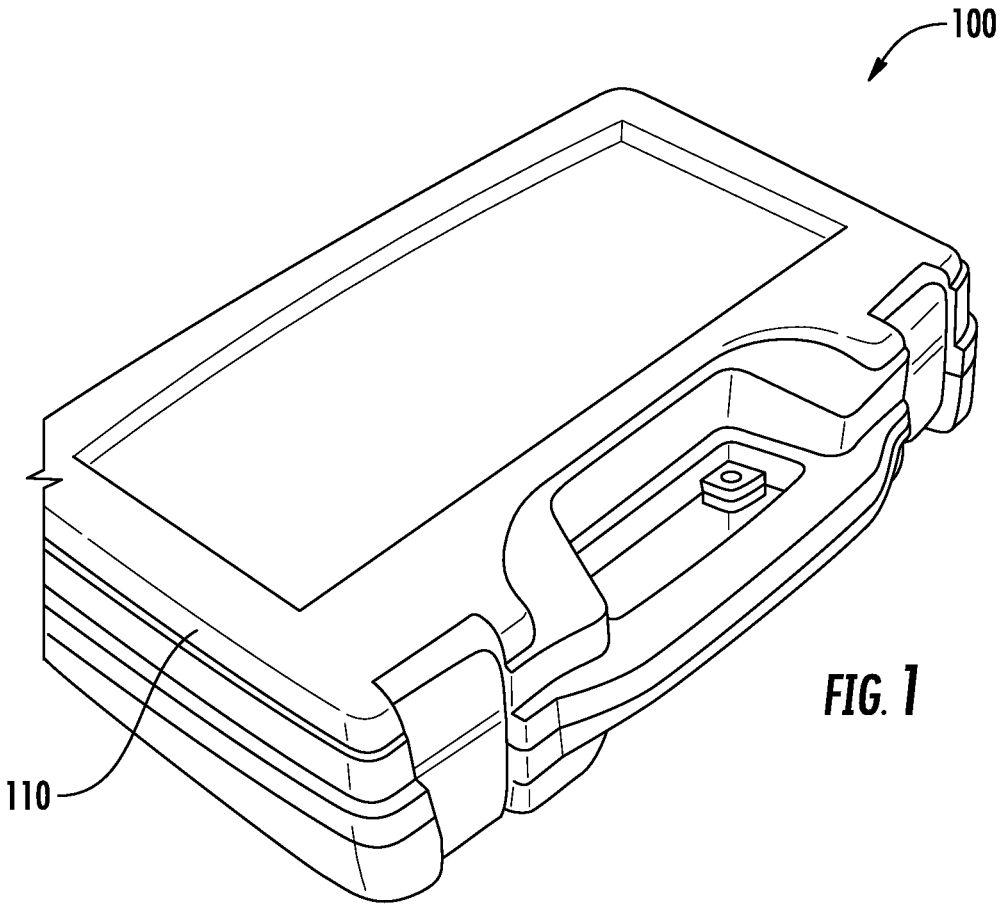
FIG. 1 is perspective view of a container apparatus according to a preferred embodiment of the invention.
Figure 2:
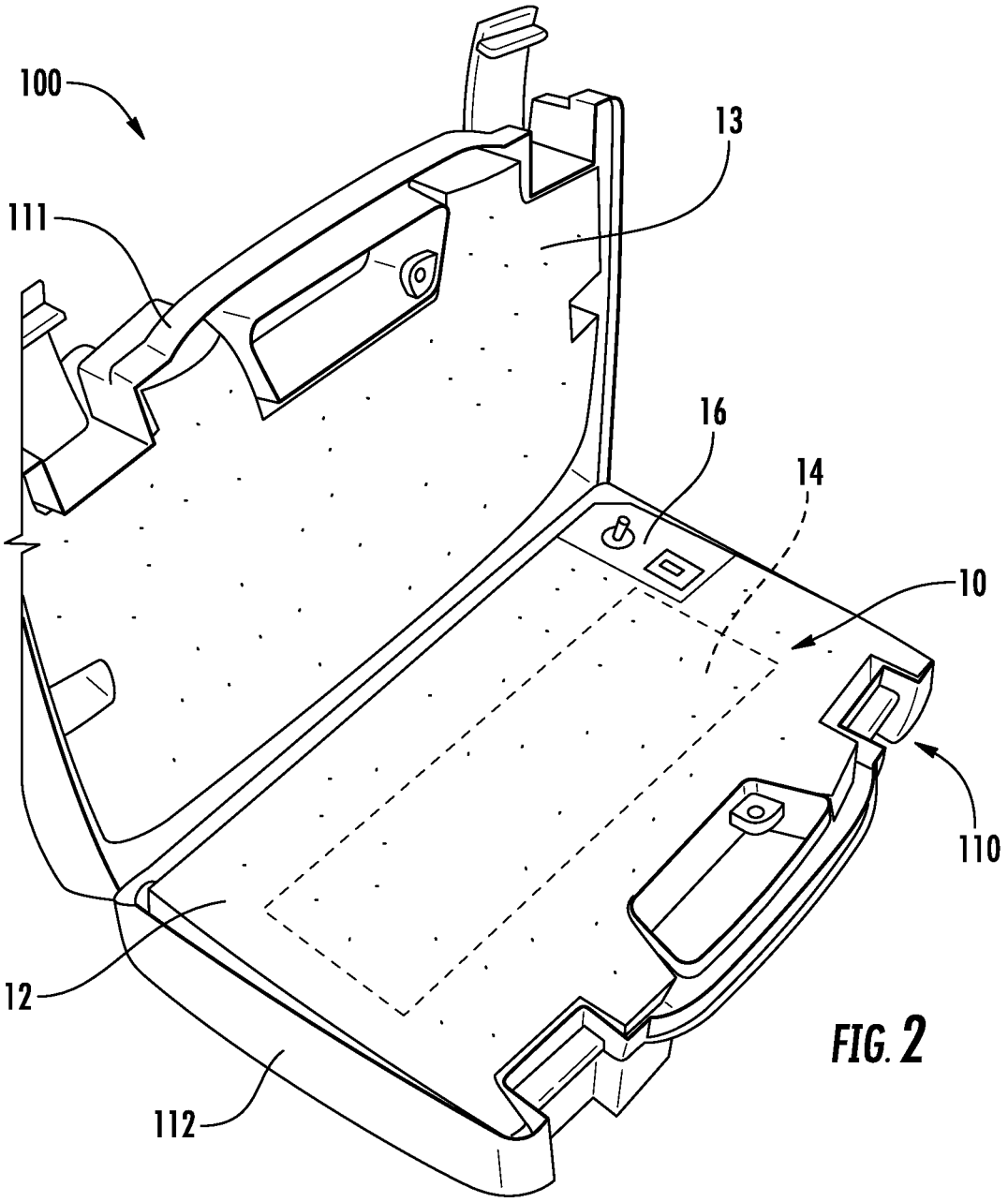
FIG. 2 is another perspective view of the container apparatus of FIG. 1.

A container apparatus according to a preferred embodiment of the invention is illustrated in FIGS. 1-6, and shown generally at reference numeral 100. The container apparatus 100 comprises a container 110, and an illumination apparatus 10 positioned within the container. The container 110 can be comprised of pivotally attached container sections 111, 112. Section 112 can be a container body, and section 111 can be a container lid, or vice versa. The container 110 can be a toolbox, fishing tackle box, gun case, luggage or other suitable container.

The illumination apparatus 10 comprises a cushioning section 12, and a light emitting device 14 positioned within the cushioning section 12. The cushioning section 12 can be comprised of solid foam. The term "solid foam" as used herein, refers generally to a soft, resilient solid material having trapped cells of gas within the solid material, and/or materials having the characteristics of foam, such as polyurethane (foam rubber), polystyrene, phenolic and other manufactured foams.

Preferably, the light emitting device 14 comprises a light emitting diode with a touch sensitive on/off mechanism, such as a capacitive touch sensor. Pressing down on the cushioning section 12 triggers the capacitive touch sensor, turning the light emitting device 14 on and off. As such, the light emitting device 14 can be turned on and off by pressing down on the cushioning section 12.

In an alternative embodiment, the cushioning section 12 is comprised of an aerogel material. The term "aerogel" refers generally to a porous ultralight material derived from a gel, in which the liquid component for the gel has been replaced with a gas. For example, the aerogel material can be silica ($SiO_2$) aerogel or tantalum ($Ta_2O_5$) aerogel.

Figure 3:
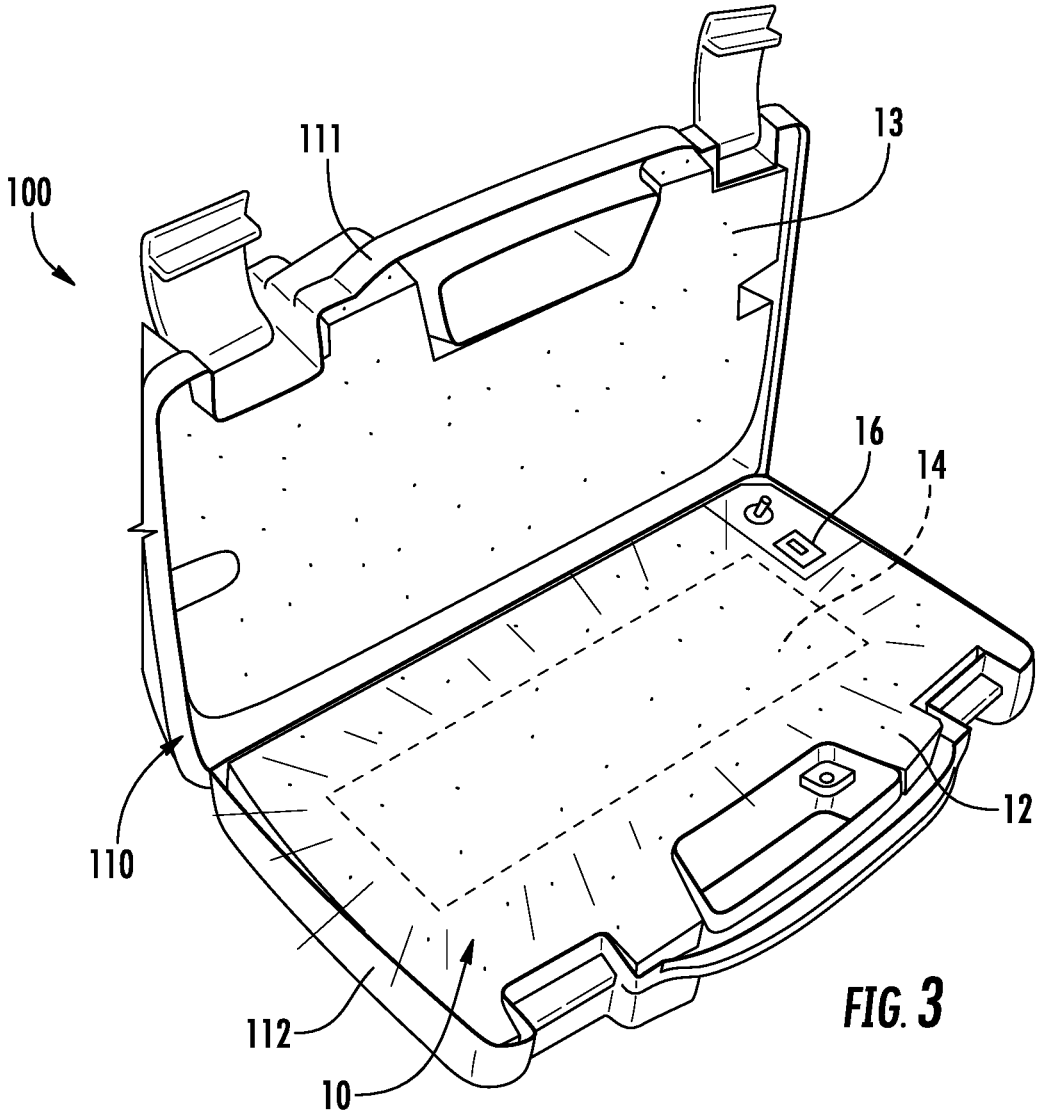
FIG. 3 is another perspective view of the container apparatus of FIG. 1.
Figure 4:
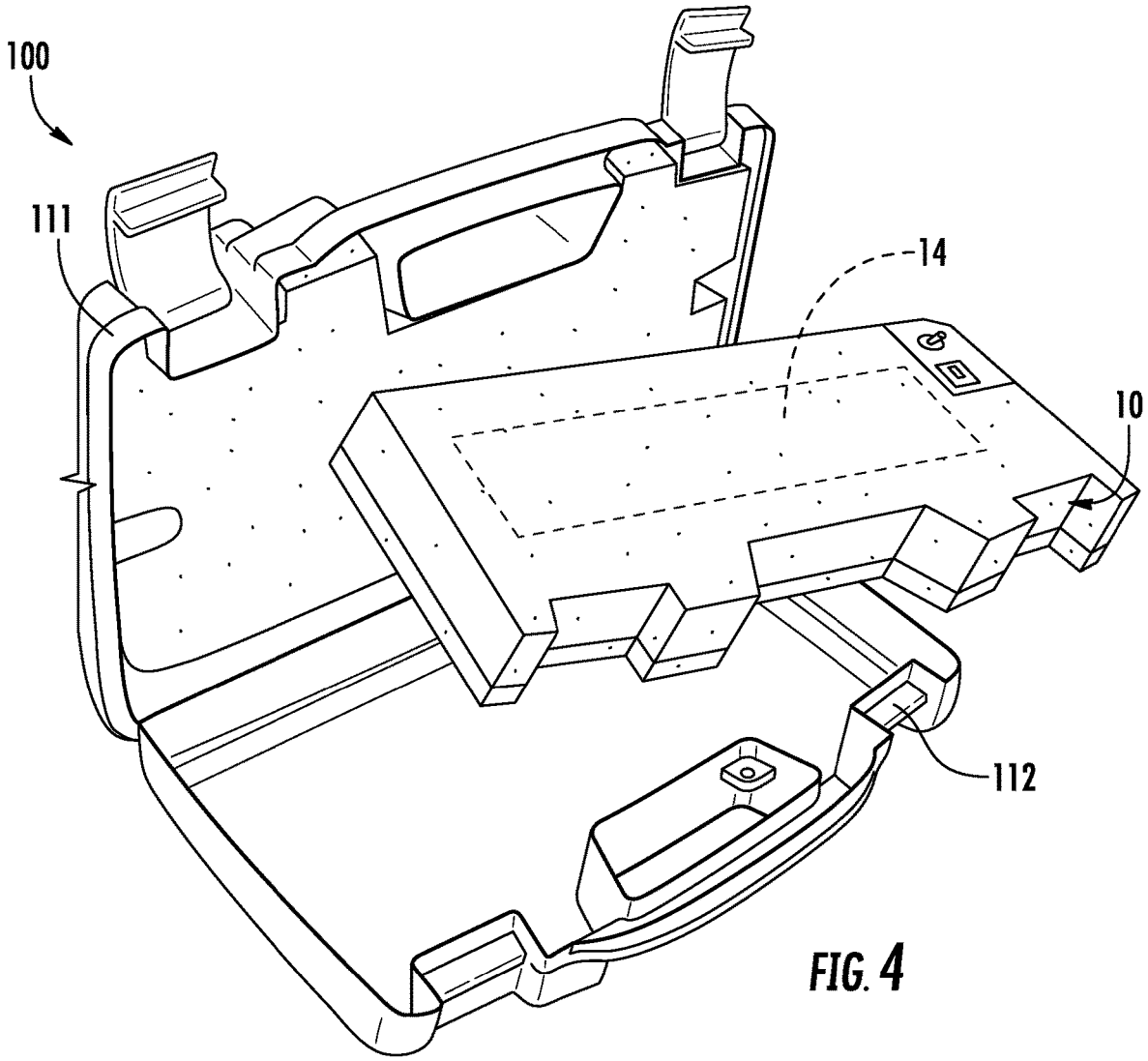
FIG. 4 is another perspective view of the container apparatus of FIG. 1.
Figure 5:
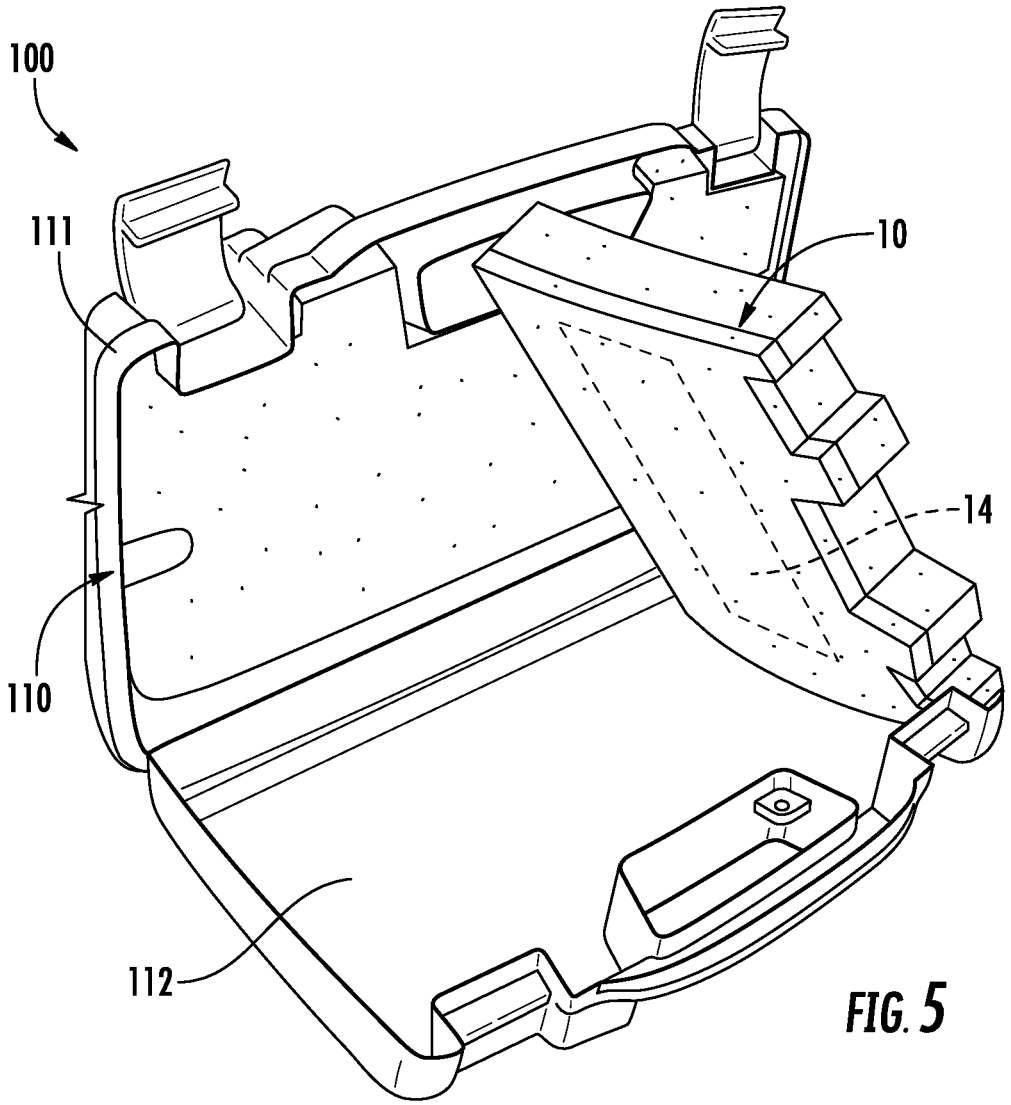
FIG. 5 is another perspective view of the container apparatus of FIG. 1.

The illumination apparatus 10 comprising the cushioning section 12 can be positioned within container section 112, as shown in FIGS. 3-5. A second cushioning section 13, made of a foam or aerogel material, can be positioned within the other container section 111.

In a method of making the illumination apparatus 10 according to the invention, a piece of solid foam is cut with a laser cutter to conform to the size, shape and dimensions of the interior of the container 110. A recess can be formed in the foam by the laser cutter, and the light emitting device 14 can be positioned within the recess in the foam. A slit can be formed in communication with the recess, whereby the light emitting device 14 can be slid and out of the recess. As such, the light emitting device can be easily removed from the foam section 12 for charging, replacing batteries or replacing with another light emitting device.

According to another method of making the illumination apparatus 10, a foam piece is cut into sections, the light emitting device 14 is positioned within the sections, and the sections are adhered together using an adhesive. Alternatively, the foam sections can be melted together using heat. Preferably, the light emitting device 14 is a light emitting diode. The light emitting device 14 is fully integrated into the foam material 12. According to another embodiment of the invention, the illumination apparatus 10 can comprise a plurality of multi-colored light emitting devices, such as light emitting diodes.

In another method of making the illumination apparatus 10 according to the invention, a hot blade is used to melt a portion of the foam piece, creating a slot within the foam in which a light emitting device 14 is positioned.

According to another embodiment of the invention, the illumination apparatus 10 comprises means for maintaining a space between the light emitting device 14 and the foam of the cushioning section 12. The illumination apparatus 10 can include a substantially rectangular frame positioned within a recess formed in the cushioning section 12. The light emitting device 14 is substantially rectangular, and is positioned within the frame. Preferably, the frame has a thickness of approximately two inches, whereby there is a space of approximately two inches between the light emitting device 14 and the foam section 12. Alternatively, the cushioning section 12 can be comprised of top and bottom layers of foam. The frame is positioned on the bottom layer, the light emitting device is positioned on the bottom layer, and the top layer is positioned over the frame.

The illumination apparatus 10 includes a power source operatively connected to the light emitting device 14 to power the light emitting device 14. The light emitting device 14 can be powered by a rechargeable battery, and can be operatively connected to a USB switch 16 that can selectively turn the light emitting device 14 on and off and charge the battery of the light emitting device 14. The USB switch 16 can be positioned in the foam section 12. Alternatively, the light emitting device can be operatively connected to a plunger switch. When desired, the user can engage the switch to turn on the light emitting device 14, which illuminates the interior of the container 12.

Figure 6:
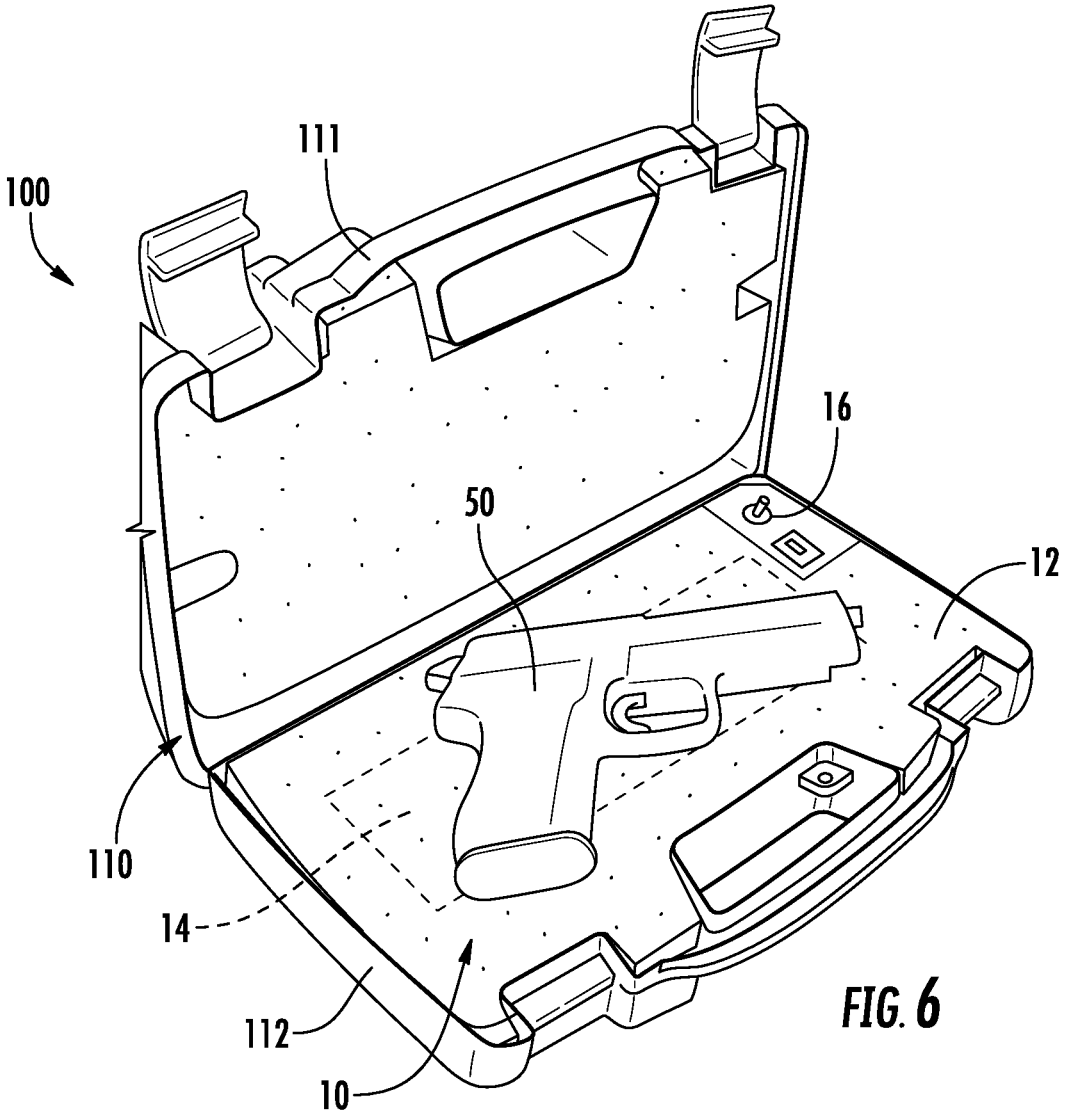
FIG. 6 is another perspective view of the container apparatus of FIG. 1.

The foam 12 of the illumination apparatus 10 provides cushioning, and stabilizes items within the container 110 and prevent their unwanted movement. For example, a firearm 50 can be positioned in the container 110, as shown in FIG. 6. The foam 12 of the illumination apparatus 10 cushions and stabilizes the firearm 50, helping to prevent unwanted movement of the firearm 50 when the container 110 is carried and moved about.

The foam 12 of the illumination apparatus 10 can be easily cut to conform to the interior size, shape and dimensions of a variety of containers. As such, the illumination apparatus 10 can be used with container 110 as well as other containers not shown in the drawings.

The light emitting device 14 is fully integrated into the foam 12. The illumination apparatus 10 illuminates the interior of the container 110 without requiring any electrical connection between the illumination apparatus 10 and the container 110. Accordingly, the illumination apparatus 10 can be used with a variety of existing conventional containers.

According to a preferred embodiment, the illumination apparatus 10 can include wireless technology, such as the wireless communication technology sold under the mark "BLUETOOTH", which is operatively connected to the light emitting device 14 and a remote control, such that the remote control can turn the light emitting device 14 on and off. The remote control can be a computing device comprising a computer processor, such as a computer or mobile smartphone. The remote control can be operated by a human user that activates the light emitting device 14 at times the user deems appropriate. Alternatively, the remote control comprises a computer processor and a non-transitory computer readable storage medium comprising software having programming instructions that, when executed, cause the computer processor to automatically activate the light emitting device 14 at a predetermined time of day. In another embodiment, the software can be integrated into a mobile application that can be downloaded onto mobile smartphones and allows a user to control the light emitting device 14 with a mobile smartphone.

A container apparatus and method of using same are described above. Various changes can be made to the invention without departing from its scope. The above description of embodiments and best mode of the invention are provided for the purpose of illustration only and not limitation—the invention being defined by the claims and equivalents thereof.

What is claimed is:

1. A container apparatus comprising a container and an illumination apparatus positioned within the container, the illumination apparatus comprising:

(a) a cushioning section;

(b) a light emitting device positioned within the cushioning section; and (c) wherein the container comprises at least one selected from the group consisting of a toolbox, fishing tackle box, gun case, and luggage.

2. The container apparatus according to claim 1, wherein the cushioning section comprises a solid foam.

3. The container apparatus according to claim 2, wherein the solid foam comprises at least one material selected from the group consisting of polyurethane and polystyrene.

4. The container apparatus according to claim 1, the cushioning section comprises an aerogel material.

5. The container apparatus according to claim 4, wherein the aerogel material comprises at least one material selected from the group consisting of silica aerogel and tantalum aerogel.

6. The container apparatus according to claim 1, wherein the light emitting device comprises at least one light emitting diode.

7. The illumination apparatus according to claim 6, wherein the light emitting device further comprises a touch sensitive on/off mechanism operatively connected to the at least one light emitting diode, whereby pressing on the cushioning section can turn the light emitting diode on and off.

8. The illumination apparatus according to claim 6, wherein the light emitting device further comprises a touch sensitive on/off mechanism operatively connected to the at least one light emitting diode.

9. The container apparatus according to claim 1, wherein a recess is formed in the cushioning section and the illumination apparatus is positioned within the recess.

10. The container apparatus according to claim 1, wherein the illumination apparatus comprises a power source operatively connected to the light emitting device to power the light emitting device.

11. The container apparatus according to claim 10, wherein the power source comprises a rechargeable battery.

12. The container apparatus according to claim 10, wherein the illumination apparatus is not electrically connected to the container apparatus.

13. A container apparatus comprising a container and an illumination apparatus positioned within the container, the illumination apparatus comprising:

(a) a cushioning section; and (b) a light emitting device positioned within the cushioning section, wherein a recess is formed in the cushioning section and the illumination apparatus is positioned within the recess, and further wherein a slit is formed in communication with the recess, whereby the light emitting device can be slid in and out of the recess.

14. The illumination apparatus according to claim 13, wherein the light emitting device comprises at least one light emitting diode.

15. The container apparatus according to claim 13, wherein the container comprises at least one selected from the group consisting of a toolbox, fishing tackle box, gun case, and luggage.

16. The container apparatus according to claim 13, wherein the illumination apparatus is not electrically connected to the container apparatus.

17. The container apparatus according to claim 13, wherein the illumination apparatus comprises a power source operatively connected to the light emitting device to power the light emitting device.

18. The container apparatus according to claim 13, wherein the cushioning section comprises an aerogel material.

19. A method of making a container apparatus comprising the steps of:

(a) providing a container having an interior surface defining a size and shape;

(b) providing a piece of solid foam;

(c) cutting the piece of solid foam to conform to the size and shape of the interior of the container;

(d) cutting an opening in the piece of solid foam;

(e) inserting a light emitting device in the piece of solid foam; and (f) positioning the piece of solid foam with the interior of the container.

20. The method according to claim 19, wherein the solid foam comprises at least one material selected from the group consisting of polyurethane and polystyrene.

* * * * *